United States Patent [19]

Gilvar et al.

[11] Patent Number: 4,491,488

[45] Date of Patent: Jan. 1, 1985

[54] STEEL ROD ROLLING PROCESS

[75] Inventors: Martin Gilvar, Oakham; Robert B. Russell, Chestnut Hill, both of Mass.

[73] Assignee: Morgan Construction Company, Worcester, Mass.

[21] Appl. No.: 444,111

[22] Filed: Nov. 24, 1982

Related U.S. Application Data

[60] Division of Ser. No. 215,331, Dec. 11, 1980, Pat. No. 4,401,481, which is a continuation-in-part of Ser. No. 111,122, Jan. 10, 1980.

[51] Int. Cl.[3] ..... C21D 8/06

[52] U.S. Cl. ..... 148/144; 266/106

[58] Field of Search ..... 148/12 B, 156, 143, 148/144, 12 R, 12.4, 157; 266/106

[56] References Cited

U.S. PATENT DOCUMENTS

| | | | |
|---|---|---|---|
| 2,894,737 | 7/1959 | Haugwitz | 266/106 |
| 3,832,788 | 9/1974 | Kato et al. | 266/106 |
| 3,865,153 | 2/1975 | Vitelli | 266/106 |
| 3,940,961 | 3/1976 | Gilvar | 266/106 |
| 3,940,967 | 3/1976 | Vitelli | 266/106 |
| 4,168,993 | 9/1979 | Wilson et al. | 148/12 B |

FOREIGN PATENT DOCUMENTS

| | | | |
|---|---|---|---|
| 1900014 | 11/1970 | Fed. Rep. of Germany | 148/156 |
| 135917 | 6/1979 | Fed. Rep. of Germany | 148/12 B |

*Primary Examiner*—Peter K. Skiff

*Attorney, Agent, or Firm*—Thompson, Birch, Gauthier & Samuels

[57] ABSTRACT

A process for rolling steel rod is provided whereby rolling rod at delivery speeds in excess of 15,000 fpm and cooling same after laying it in spread-out ring form on a conveyor is made feasible with less risk of cobbles and improved rod quality especially in the medium to high carbon content range by entering the rod after rolling into the laying head and thereafter cooling same non-uniformly through a grain size growing phase and a transformation phase with the non-uniformity of cooling rate during the transformation phase being kept in substantially inverse proportion to the differences in effective grain size established in the first phase. In addition a very long cooling conveyor which is necessitated by such delivery speeds (not only for high carbon steels but also low carbon and low alloy steels) is provided without requiring additional horizontal space, by arranging the conveyor in a multiplicity of tiers, spaced vertically, running in opposite directions, and being provided with means for transferring the rings from one tier to the next. Cobbles on the conveyor at high delivery speeds are minimized by coiling with ½" spacing, and by reforming means adapted for high speed delivery of rings from the conveyor onto an upwardly sloping mandrel surface, or into a curved chute which stacks the rings on their sides. An intermittent reheat method is employed for processing rod where slow cooling and/or heat treatment at a steady temperature is required.

5 Claims, 12 Drawing Figures

PRIOR ART (STELMOR)

ECONOMY REVAMP (560')

DELUX REVAMP (780')

STEEL ROD ROLLING PROCESS

This application is a division of application Ser. No. 215,331, filed Dec. 11, 1980, now U.S. Pat. No. 4,401,481, which is a continuation-in-part of Ser. No. 111,122 filed Jan. 10, 1980 (to be abandoned or covered by additional continuing applications).

FIELD OF THE INVENTION

The present invention relates to the hot rolling of metal rod and more particularly to a process and apparatus for the combined hot rolling and cooling of steel rod, as well as to the rod product itself.

BACKGROUND OF THE INVENTION

Traditionally in commercial practice, prior to 1964, immediately after steel rod was rolled, it was coiled into bundles while still hot (either with or without air cooling in the reels). Thereafter it was cooled on a flat, chain conveyor until it was firm enough to be hung on a hook carrier without sagging, whereupon it was transferred to a hook carrier and cooled down to room temperature while hanging in the open air. The cooling took a long time and resulted in a major loss of metal (usually about 1.5%) due to the rapid oxidation of the steel at elevated temperature. In addition the metallurgical structure of the steel was poor and the rod (in the medium to high carbon content range) had to be subjected to a heat treatment (called "patenting") before it could be cold worked into a finished product. Various efforts to accelerate the cooling to reduce scale and improve the structure included (a) immersing the rod in water immediately after rolling (U.S. Pat. No. 459,903; 895,973); (b) spraying water onto the rod as it was being coiled (U.S. Pat. Nos. 854,808; 3,011,928); (c) passing the rod through a delivery pipe equipped with water spray nozzles, prior to coiling it (U.S. Pat. Nos. 1,211,277; 1,672,061); and (d) blowing air onto or through the bundles after (or during) coiling (U.S. Pat. Nos. 2,516,248; 2,810,569). By optimally combining one or moreof those techniques it was possible, on a commercial scale, to shorten the cooling time to about 30 minutes, and to reduce the metal loss by oxidation to about 1.0%. Through the years it was, of course, known that very rapid cooling and an even smaller scale loss could be achieved by increasing the application of the water, but when such was done with medium-to-high carbon content steel rod, even with very sophisticated controls (see e.g. U.S. Pat. Nos. 2,756,169 and 2,994,328), the adverse effects of surface hardening caused thereby, yielded such an unsatisfactory product that those processes were never adopted commercially for the sequential rolling and cooling of medium-to-high carbon content steel rod.

In the early 1960's when the process described in U.S. Pat. Nos. 3,231,432; 3,320,101; and 3,390,871 (which process is now commonly referred to as the "Stelmor" process) went into commercial operation, a very substantial improvement in rod quality together with a reduction in cooling time and scale loss became possible. This was accomplished by first rapidly water-cooling the rod from a rolling temperature of about 980° C. to about 780° C. in the delivery pipes. Thereafter the rod was formed into rings and deposited in off-set, overlapping relation on an open conveyor, and further rapidly cooled thereon by blowing air through the rings. The Stelmor process was extremely successful because it succeeded, for the first time, in providing a rod product in the medium-to-high carbon content range which was equal to an "air patented" rod. Although it did not have the quality of a lead patented rod, it still could be drawn or cold worked to a finished, saleable product in many instances without requiring any subsequent heat treatment. The savings gained by the Stelmor process were tremendous (over 10% of the price of the rod), and the Stelmor process went into immediate and widespread use.

The most difficult thing to understand about the Stelmor process, for those skilled in the art at the time, was how the rod properties could be as uniform as they were. Thus, in conventional patenting processes, it had always been necessary to take care to prevent the rod strands from touching each other because, in conventional patenting, when the strands touched each other, the reduction in cooling rate caused thereby produced soft spots in the rod (i.e. coarse lamellar pearlite—and large free ferrite deposits). On the other hand, with the Stelmor process the rod is coiled into spread-out rings on the conveyor with many parts of the rings touching in such a way that uniform cooling is impossible. In fact, the overlapped or grouped portions of the rings remain bright red in some cases as long as seven or more seconds after the individual nontouching parts of the rings turn black such that significant non-uniformity of the cooling rates from place to place along the rod is plain to see. The resulting product is, nevertheless, sufficiently uniform to meet the industry standards of a properly "air patented" rod. The explanation of this apparent nonsequitur was initially believed to be that, in the preferred practice of the Stelmor process, the air was blown more intensively onto the edges of the conveyor where there is a greater concentration of metal. In fact the earliest attempts to improve the Stelmor process involved coiling the rod in various ways to avoid accumulation of the rod at the sides of the conveyor (see e.g. U.S. Pat. Nos. 3,405,885 (Schloemann), 3,454,268 (Yawata), 3,469,429 (Schloemann), 3,469,798 (Schloemann), German Nos. 1214635, 1240541 (Demag), 1245403 (Demag) and others). Experiments, however, showed that selective blowing the air was responsible for only a minor part of the explanation, and in fact, none of the attempts to improve Stelmor by special forms of coiling and blowing have brought about anything more than minor improvement.

Eventually the reason why the Stelmor process produces acceptably uniform product was found to be due to cooling the rod rapidly after rolling so as to produce uniformly small austenite grains prior to transformation and then to cool the rod continuously and relatively rapidly through transformation. More specifically, in the Stelmor process, the rod is cooled preliminarily by water in the delivery pipes immediately after rolling. During rolling, the austenite grains in the steel are, of course, fragmented and immediately thereafter they recrystallize and start growing from extremely small size under conditions of ample excess heat above $A_3$. Thus, they grow very rapidly and uniformly by the merger of adjacent grains. The preliminary water cooling, however, arrests the grain growth process, and, in the Stelmor process, grain sizes of about ASTM 7.5 or smaller and variations in grain sizes of less than ±ASTM 0.5 along the length of the rod are usual.

In conventional patenting, however, a grain size of ASTM 7.5 was normally considered undesirable for a number of reasons. First, at any given cooling rate, smaller grains will precipitate larger amounts of free ferrite due to their larger surface-area-to-mass ratio, and the precipitation of free ferrite is normally undesirable. Second, small grained products often have poorer work hardening properties due in part to their shorter free path between grain boundaries and the usual presence of more free ferrite at the grain boundaries. In the Stelmor process, however, the disadvantages expected from the small grains do not, in fact, appear in the product for reasons that are not fully understood, and, in addition, an important special benefit results from the smallness. Small grains transform more rapidly than larger grains (see Grossmann & Bain "Principles of Heat Treating" 1964, p. 71). While this has been known per se for many years, the explanation of why it is beneficial in the Stelmor process was not known. Thus, when the rod rings are cooled on the Stelmor conveyor, transformation will start first at the most exposed places where the cooling rate is highest. In fact, as the rod with high carbon content cools, one can stand alongside the conveyor and observe the redness of the most exposed parts at first diminishing until it becomes nearly black, and then, as transformation sets in, immediately turning red again due to the liberation of the latent heat of transformation. This reappearance of red color occurs first at the point where the rod has been cooled most rapidly. It then immediately spreads, however, along the rod toward the warmer places where the rod rings are closer to each other. It has been postulated (see U.S. Pat. No. 4,168,993) that this spreading causes a "triggering" of transformation along the rod, which induces transformation to proceed more rapidly elsewhere in the rod (i.e. without preliminary super-cooling). Accordingly, due both to the smallness of the grains and possibly to the "triggering" action, as soon as the transformation temperature is reached at any given place along the length of the rod, transformation starts immediately and proceeds rapidly to completion. Thus, even though the various places along the rod transform at different times, they do so at very nearly the same average temperature of transformation. This yields a product which is at least sufficiently uniform along its entire length to be equal in uniformity to a properly "air patented" rod of the same composition.

Although the Stelmor process represented a major breakthrough, there was still room for improvement. Thus, although the quality of the Stelmor rod product was an improvement over the prior art, its UTS was still about 7% to 9% below that of lead patented rod of the same grade. In addition its uniformity, although within the allowed latitude, was substantially less than that of lead patented rod. Thus, the standard deviation in UTS of Stelmor rod usually runs around 1.5 $Kg/mm^2$, whereas the standard deviation of lead patented rod is usually below 1 $Kg/mm^2$. In view of the fact that substantial quantitites of rod, even though processed by the Stelmor process, still require lead patenting, many attempts have been made to improve the Stelmor process to achieve the equivalent of lead patenting.

The first approach tried was to provide special forms of coiling and/or blowing in order to make the application of the air more uniform (mentioned above). Those efforts, at best, yielded insignificant improvement.

In another series of attempts to improve on Stelmor the artisans reasoned that the quality of Stelmor rod fell short of that of lead patented rod because the grain size of the prior austenite in Stelmor rod was too small. They, therefore, predicted that a much better product could be made by letting the austenite grains grow to the larger sizes (i.e. ASTM 3 to 5) used in conventional patenting (see U.S. Pat. Nos. 3,547,421 (col. 1 lines 42–75); 3,645,805, 3,783,043, and U.K. Pat. No. 1,173,037). According to those suggestions, the grain enlargement was to be done by holding the rod at high temperature for a substantial period (i.e. 12 to 30 sec) so that the grains would grow to a uniform large size (i.e. ASTM 5 or larger). Thereafter in one process (i.e. U.S. Pat. No. 3,735,966) the rod was to be cooled rapidly down to transformation temperature and then held isothermally for transformation. In the other form of this process (i.e. U.S. Pat. No. 3,783,043) the rings containing large grained austenite were to be air cooled uniformly on an open conveyor by constantly shifting the rings so as to avoid non-uniform cooling due to the overlapped places (col. 6 lines 19–24). Those processes, however, despite claims for improvement not only failed to improve on Stelmor, they were, in fact, not equal to Stelmor. The uniformly large austenite grains produced by those processes were not suitable for cooling under the non-uniform cooling conditions which cannot be avoided when rod is laid out on a conveyor, even by constantly shifting the rings.

In the wake of the failure of the attempt to improve the quality of Stelmor rod by enlarging the austenite grains, the industry then turned in the opposite direction and proposals began to appear for making the austenite grains even smaller than in Stelmor by accentuating the preliminary water cooling, and, in fact, proposals were even made to perform the entire cooling cycle with water (see U.S. Pat. Nos. 3,704,874; 4,011,110; 4,016,009; German Pat. No. 2345738, and German OS No. 2746961).

Cooling the rod entirely with water, however, is extremely difficult to control if an equivalent to at least air patented rod is to be produced. For example, the authors of German OS No. 2746961 claim that a better rod product than that of the Stelmor process can be made by immersing the rod in water directly after rolling. Those claims, however, have not been substantiated. Small samples having a good micro-structure can be made in a laboratory, but the same conditions cannot be duplicated in production. The rod can, in some cases, be drawn to as small a diameter as a normal air patented rod, but, due to non-uniformity of structure between the surface and the core of such water cooled rod, the finished product has not, so far, in most instances, been acceptable without an intermediate patenting treatment. Thus, although an advantage in terms of shortening the length of the mill can be gained by the water cooling process, the major advantages of the Stelmor process are lost, and additional complications of water recycling and control are undertaken.

In fact, although a great deal of effort has been expended over the years trying to improve the quality of medium to high carbon Stelmor rod, little, it any significant progress has been made.

In addition to trying to improve rod quality, however, a great deal of effort has also been expended by rolling mill builders over the years, in attempting to improve a number of other aspects such as increasing rod rolling speed, reducing cobbles, and also providing sufficient versatility in a Stelmor type installation to adjust it for change from Stelmor-type treatment involving rapid cooling for high carbon grades, to retarded cooling for low carbon grades, to slow cooling (in a furnace) for low alloy grades; and to provide these things at a sufficiently low cost to be economically attractive.

Since the present invention is also addressed to the solution of these further problems, in combination with improving the rod quality, the technical aspects thereof and the present state of the art relating to them should also be discussed prior to describing the invention.

The basic problem involved in simultaneously increasing rolling speed, reducing cobbles, improving rod quality, providing versatility of in-line treatments, and doing it all inexpensively is that each aspect conflicts with the other. For example, increasing rolling speed also normally increases cobbles, particularly in a Stelmor type installation. Thus, even with normal rolling speeds of today's mills, i.e. 15,000 fpm, delivery pipe cobbles are a vexatious nuisance. But yet, if one is contemplating increasing the production rate, one must also contemplate making the delivery pipes ever longer than they are today, which, in turn, increases the risk of cobbles in the delivery pipes. Of course, tonnage production rates can be increased by rolling larger rod diameters with less cobble risk, but any grains made by so doing are offset by losses downstream in the further processing of the rod. The cheapest way to reduce the cross-section of the metal is by hot rolling. Moreover, hot rolling is done without introducing work hardening into the product which often has to be removed by subsequent costly heat treatment. Thus, the economically best way is to roll the rod to the smallest diameter feasible, i.e. down to the point where the increase in the incidence of cobbles due to the smallness (i.e. weakness) of the rod commences to outweigh the advantages of small size in further processing. In view of these considerations, until the present invention, there has appeared to be but little hope of significantly increasing the production rate of hot rolled rod (that is to increase the delivery speed of no. 5 rod beyond 20,000 fpm) without at the same time escallating the cobble risk to such an extent as to negate the economic advantage of increased rolling speed.

Similar considerations apply to problems of handling the rod rings on a Stelmor type cooling conveyor and in the reforming stages in which the rod rings are projected into a reforming tub or a collector, when they reach the end of the conveyor. If the delivery rate of the rod from the rolling mill is to be raised, for instance, to 20,000 fpm for no. 5 rod, which has recently been demonstrated to be feasible, the rod will issue from the laying head at a rate of 33 rings per second, at which rate it must be carefully handled in order to avoid a serious problem both with respect to cobbling on the conveyor due to the high rate of accumulation, and in the reforming stages due to the high rate at which the rings are projected from the end of the conveyor into the reforming tub.

Rod product quality can also be adversely affected by increasing the production rate. Obviously, if the delivery rate is to be increased to achieved a rolling rate of 20,000 fpm or more, everything else must also be increased in order to achieve at least the same desired cooling conditions as are in current use for Stelmor quality rod (i.e. water cooling in the delivery pipes to 1450° F. (803° C.), followed by forced air cooling with at least 2" ring spacing on centers). Unless the equipment is increased proportionally the cooling conditions will be decreased from the present norm. On the other hand, a delivery pipe and conveyor of commensurate length would require increasing the length of the building by about 300' at a cost of roughly $1M for building alone ($3500 per foot), to say nothing of the extra cost of the equipment. But totally apart from these very substantial extra costs, a commensurately long delivery pipe is considered to be undesirable. This being the case, it has been assumed, prior to the present invention, that standard Stelmor quality rod (in the medium-to-high carbon content range) could not be produced if production speeds of No. 5 rod were to be increased much over 20,000 fpm, due to the difficulty of providing adequate water cooling and the cost of providing and housing a conveyor of adequate length.

In addition, providing versatility sufficient to include slow cooling, retarded cooling or even short term annealing, which is difficult enough, at the present production rates, would become proportionally more difficult if the production rates were increased. For example, one of the problems encountered in some installations for slow cooling is the stacking of the rod rings on the conveyor. If the conveyor speed is slowed down such that the spacing between rings (on centers) is less than about ⅓", the rings build up in bunches on the conveyor with the bunches periodically cascading down to the conveyor level. Projecting the rod from the laying head at a rate of 33 rings per second onto stacks of randomly varying height causes undesirable non-uniformity on the conveyor, and reforming the rod rings from the conveyor in such a state of cascading bundles is difficult, and tends to cause stoppages in production. On the other hand, if the conveyor is run at a speed at which the ring spacing is sufficient to provide for uniform laying and convenient reforming, i.e. greater than ⅓" spacing, then a very long conveyor will be needed as well as an equally long insulated chamber or furnace as the case may be if versatility is desired. For example, if a rolling speed of 20,000 fpm were to be used, a ring spacing of ⅓", and a time on the conveyor at elevated temperature only of five minutes as required for short term annealing (see U.S. Pat. No. 3,939,015), the conveyor would have to be at least 400' long to provide for the slow cooling on the conveyor plus a section on the conveyor for cooling the rod down to handling temperature after it leaves the annealing furnace.

Another problem in slow cooling, retarded cooling, and/or annealing is uniformity of treatment. One might think that placing the rings in a heavily insulated oven or in a furnace, in the form of compact, matted closely spaced rings, would provide high uniform cooling or heating conditions. Experience, however, shows that greater uniformity is still desired. Evidently, portions of the rings on the edges of the bundles simply do not cool or heat up at the same rate as other portions within the bundle.

As a result of this panorama of apparently irreconcilable conditions, the industry has been willing to settle for small grains in one or a few specific areas to the sacrifice of losses elsewhere. For example, a proposal was recently made for rolling the rod at a speed of 80 m/sec (14,880 fpm), including a delivery pipe of 142' in length and a 234' conveyor with seven forced air cooling zones. A delivery pipe of such length at such a rolling speed for No. 5 rod, however, increases the risk of cobbles. The delivery pipe can be shortened somewhat (by about ⅓) by the use of interstand cooling in the finishing mill, but even so with a 234 conveyor, at a delivery rate of 80 m/sec the ring spacing has to be so close (about 1½") that achieving an optimum Stelmor type cooling rate for medium-to-high carbon rod is difficult. Moreover, it is also barely feasible to cool low carbon rod slowly enough for long enough on such a short conveyor at such delivery rates, together with cooling the rod when it reaches the end of the conveyor rapidly enough to permit handling in the reforming area. In fact, it has been proposed to install a water spraying station at the end of the conveyor so that the slow cooling of low carbon rod can be extended as far as possible along the conveyor. The problem, of course, with water spraying is that, in places where the rod is still at transformation temperature (in the matted-overlapped areas), the water quench will harden the rod undesirably.

One attempt to shorten the length of the conveyor which has achieved a good deal of publicity over the years (briefly touched on above) has been to drop the rings onto a conveyor into boiling water in which the steam is supposed to form a barrier which prevents chill hardening (see e.g. U.S. Pat. No. 3,788,618). It was tried in Canada in the early 1960's. Later on (around 1965) it was suggested by CRM in Belgium, and lately an English company claims to have invented it (see Metal Producing, Sept. 1979, pp. 52–53). Over the past 15 years the process has always been on "the verge" of achieving patented quality rod on a commercial scale. The most recent installation, known to applicants, has been scheduled for commercial production now for two years. Such processes, while possibly satisfactory for the production of small, laboratory controlled samples are not suitable. Thus, although the process might greatly shorten the required length of the conveyor for high carbon rod, it does not perform satisfactorily on high carbon, and it cannot be used for the slow cooling of the major tonnage item, i.e. low carbon rod.

In view of these obstacles to progress, the present state of the art discloses that the industry has literally been groping—making small gains here and there—but always pushing the limits of feasibility in one area at the sacrifice of losses elsewhere.

In fact, to date, there has been no general attack simultaneously on the objectives of increasing rolling speeds, reducing cobbles, improving quality, and providing versatility, all at low extra cost, nor has there been any apparent hope for their combined solution let alone major gains in any one area.

BRIEF DESCRIPTION OF THE INVENTION

In the present invention, a broadside attack has been launched on all of the above-outlined objectives simultaneously, and major advances have been made in each category with the result that the present invention demonstrates an economic advance equal to, or of even greater proportions than was the Stelmor advance of the 1960's described above.

The salient features of the invention are as follows:

(a) The invention provides for increased rolling speed above 20,000 fpm (100 m/sec) while at the same time reducing the risk of cobbles in the delivery pipe, on the conveyor, or in the reforming area.

The invention provides for increasing the rolling speed above 20,000 fpm while at the same time reducing the risk of cobbles in the delivery pipe. This is achieved by the simple expedients of increasing the length of the finishing train, operating the mill faster and greatly reducing the length of or eliminating the delivery pipes entirely. (How this can be done without loss of rod product quality will be explained below). Thus, when the rod issues from the final finishing stand, it is immediately passed through a short guide tube in which a small application of water can be made and then into the rotating tube of the laying head. The laying temperature of the rod is regulated as may be required (in cases also to be discussed below) down to about 1550° F. (854° C.) either by interstand cooling in the finishing train or by water cooling in the short delivery pipe. The result is to reduce delivery pipe cobbles to an absolute minimum and permit high speed rolling down to diameters such as 0.218" O.D. and even smaller (particularly with low rolling temperature). In addition, equipment costs are reduced and space is saved by the elimination of the delivery pipes and pinch rolls.

Cobbles on the conveyor are avoided, by projecting the rings onto a belt type (wire mesh) conveyor at a rate of forward travel which is at least 25% faster than that of the conveyor, and with a spacing on the conveyor of at least ½". In this way as the rings fall, their lowest points strike the conveyor more or less at a standard height, and the rings tip forward in relatively uniform succession. Immediately downstream of the laying point, the rings are transferred to an open bar-chain-and-lug-drive type conveyor equipped with forced air cooling. Since, in some cases, a ring spacing of up to 3" on the conveyor will be required (for reasons to be later explained), and since the forward projection rate of the rings from the laying head must exceed the conveyor speed by at least 25%, the laying head is designed to project the rings at a vertical spacing of 4" between rings which equates (at a rolling speed of 20,000 fpm) to a forward travel rate of 660 fpm with the conveyor travelling at 495 fpm. (This, of course, requires the use of a very long conveyor. How this is accomplished by the invention, without requiring additional space, will also be explained below).

Cobbles in the reforming area are controlled by placing a mandrel in the collecting tub the top of which is slanted forwardly and upwardly from the conveyor level so that the leading edges of the rings ride up over it while the trailing edges of the rings drop before reaching the mandrel and fall properly in place. Alternatively, the invention offers a new form of rod ring collection in which the rings are projected from the conveyor into a spiral chute which both twists them and tips them downwardly onto their sides in a tunnel on a conveyor which moves them along standing on their sides (responsive to photocell detection) at the same rate at which they accumulate in the tunnel.

(b) The invention also provides improved rod product quality in the medium-to-high carbon content range, despite very high rolling speed The improvement in rod quality of the present invention stems from the discovery of a hitherto unnoticed aspect of the metallurgy of cooling steel rod which has opened the way to substantial improvement in the quality of the rod product whereby medium-to-high carbon steel rod can now be rolled at very high rolling speeds and at the same time still have rod properties which are substantially superior to standard Stelmor rod described above.

The hitherto unnoticed fact is that, contrary to previous beliefs, it is *desireable* to promote *non-uniformity* in the effective size of the austenite grains in the steel while the rod lies on the conveyor at temperatures above transformation. When this is coupled with cooling the rod through transformation maintaining the same proportional non-uniformity of cooling conditions on the conveyor, the various cooling rates at different places along the rod can be held respectively inversely proportional to the respective austenite grain sizes at those places and thereby achieve near optimum cooling along the entire length of the rod. In this way a compensation effect takes place, and uniformity is achieved despite non-uniform cooling.

Throughout the entire history of the Stelmor process and of the other similar processes proposed since the advent of Stelmor in the early 1960's, the emphasis of the artisans has been to try to make the austenite grain size of the steel as uniform as possible along the length of the rod and to try to blow the air as uniformly as possible relative to the accumulation of the rod mass on the conveyor (i.e. more air on sides than in middle). Thus, as noted above, in Stelmor, the water cooling was intended to reduce the austenite grain size to a point at which further grain growth was unlikely, and then the air cooling was intended to cool the rod through transformation as rapidly as possible with more air being blown on the sides of the rings where there is more accumulation of metal, than in the middle. Numerous tests showed that the average tensile strength was lower in the areas of rod accumulation, and that a higher cooling rate at the side edges was, in fact, desirable, and in actual practice, with the small grains of the Stelmor process, transformation was generally so rapid, that even though the cooling during transformation was non-uniform, it did not result in an unacceptably non-uniform product. Other processes were similarly conceived. For example, the Schloemann process (U.S. Pat. No. 3,735,966) attempted to achieve grain size uniformity by very rapid water cooling in the delivery pipes followed by an attempted isothermal transformation. Templeborough Rolling Mills, in England, tried the reverse. They tried to grow the grains as large as possible (see U.S. Pat. No. 3,783,043), i.e. uniformly larger than ASTM-5, and they then attempted to avoid non-uniform cooling on the conveyor by shifting the rings while cooling them through transformation (see col. 6, 1. 19–24).

What escaped all of the artisans (as far as we know) was that, if the rings are laid at high temperature (i.e. above 850° C.), in overlapping rings, and cooled non-uniformly by air blowing through the non-uniformly distributed rings, the austenite grains at various places along the rod grow effectively at substantially different rates due to the non-uniform cooling caused by the overlapping condition of the rings; and, if substantially the same relative non-uniformity of cooling is then properly controlled, and average transformation is reached after laying while the grain growth process is still taking place (i.e. about 15 to 35 sec.) the larger grains will cool through transformation more slowly and the smaller grains will cool more rapidly through transformation in proportion to the respective optimum transformation rates for their respective effective grain sizes. Undoubtedly, to a certain degree, non-uniform grain growth took place in the prior art processes such as the Stelmor and Templeborough Rolling Mills processes, and thereafter a further degree of compensation for non-uniform cooling rates through transformation undoubtedly resulted. In fact, in the usual practice of the Stelmor process, the water is not applied to the first ten or so rings of each billet because of the increased risk of cobbles which driving the front end of the rod through water causes. Thus, the effect we describe undoubtedly takes place even more (although not optimally) on those rings. On the other hand, the front ends have always been through to be too non-uniform. In fact, in the high hardenability grades they have repeatedly shown martensite, and as a result they have been cut off and discarded in the usual practice for many grades.

Thus, although it actually took place to a degree in these prior processes, the prior artisans were not aware (so far as we know) of the effective grain size compensation feature and, as a result, they failed to see how to optimize their processes. Thus, in the Templeborough process (U.K. Pat. No. 1,173,037) in order to avoid non-uniformity, they thought they needed to shift the rings, while they were cooling through transformation, but this only made things worse. In the end they were forced to reduce their cooling rate and the product fell below standard Stelmor in quality. Later on, (according to our information) they stopped using it and shifted to Stelmor.

As illustrating that standard Stelmor did not achieve optimum results, one needs only to compare it to the rod of the present invention. Careful analysis of the respective microstructures with an extremely accurate instrument called the "Quantimet" by which the free ferrite can be accurately quantified (about which more will be stated below), shows that the process of the present invention provides a major reduction of the free ferrite on the order of 2 to 1, along the entire length of the rod despite the widely differing cooling rates and grain sizes. In addition, substantially less lamellar pearlite is visible compared to standard Stelmor.

That the effective grain size variation was compensating for the non-uniform cooling is believed to be a new discovery despite the fact that much of the grain size and uniformity data from which the discovery could have been extracted, has been available to many people for many years.

The significance, of course, is that by the use of this new technology, the present invention permits one to proceed with little or no water cooling in a delivery pipe, while simultaneously showing how to optimize the quality of the rod product, and how to do it at delivery speeds in excess of 20,000 fpm in a comparatively cobble-free context.

Test data further shows that improvements of at least 3% and over 8% in UTS can be achieved by the process of the invention in some grades, without loss of ductility, and when this is coupled with the improved work hardening characteristic of the product due to its small amount of free ferrite, the process appears to have achieved the elimination of lead patenting which the Stelmor process was never able to do. It is necessary at this stage to say "appears" because extended commercial usage is needed in order to be sure, and the product has not yet been put to such a test. At least a claim to significant improvement can now be made.

The optimum conditions for processing medium-to-high carbon rod by the method of the invention vary for different steels. In some cases, e.g. MB spring steel, very high laying temperature followed immediately by mild forced air cooling with up to 3" spacing between ring centers and then stronger forced air cooling during transformation, is desired. On the other hand, for coarse grained steels as well as for high hardenability grades, if the rod is laid at too high a temperature, excessive grain growth will take place and cooling thereafter must be slower or else martensite or bainite will appear at the more rapidly cooled places (particularly if the rod is shifting significantly on the conveyor). In such cases, regulation of the laying temperature may be done by interstand cooling which can be used to bring the laying temperature of the rod down to about 1550° F. Tests have shown that this can be done at 1750° F. with a surprisingly small increase in the bearing load on the rolls in the finishing mill.

The high carbon steel process of the present invention is still in its infancy. A variety of further tests are in progress and it is still too early to say how much can be accomplished. At least it is already known that a rod apparently equal to lead patented rod can be produced in at least one grade of steel.

The sole drawback of the inventive process in the medium-to-high carbon range, is scale. The loss of metal due to additional oxidation is about 0.6%, i.e. about twice as much as the metal loss in the standard Stelmor process. This disadvantage is regarded as insignificant when compared to the major gains of the process in increased production rates, reduction in cobbles, and improvement in rod quality.

We will reserve our discussion of rod quality for low carbon and low alloy grades to the section below which deals with the provision for versatility.

(c) The invention also provides for greatly increased conveyor length without increasing the over-all length of the mill Up to this point we have shown how the invention makes possible a major increase in production rate, a reduction in cobbles, and an improvement in rod quality in the medium-to-high carbon grades, but these gains can be achieved only with a very long conveyor. For example, assuming a rolling speed of 20,000 fpm, if an average cooling rate of 12° C./sec is to be achieved (believed to be necessary for some grades), a ring spacing of 3" will be needed, a conveyor speed of about 500 fpm will also be needed, and a dwell time on the conveyor of 66 seconds will be required. This means that the conveyor will have to be at least 550' in length.

There are many other reasons why a very long conveyor is needed or desirable especially for slow cooling larger diameter rod and for cooling in the low carbon, and low alloy grades to be discussed below. Accordingly, in the present invention a conveyor of at least 550' in length is employed.

The way this is achieved without increasing the length of the mill is by doubling the conveyor back onto itself to form three superimposed tiers which may also be offset laterally. When the rod reaches the end of the uppermost tier, it falls into a curved chute which flips the rings downwardly and in the reverse direction onto the middle tier at the end of which the rod again falls into a curved chute and down onto the bottom tier which conveys the rod to the reforming station.

In the context of a revamp of a typical existing Stelmor installation, a feasible configuration would provide a conveyor 560' in length while still using the existing Stelmor conveyor. In a more elaborate revamp, a conveyor length of 780' can be provided without increasing the length of building of a typical Stelmor installation of the late 1960 vintage.

A number of ways to transfer the rings from one conveyor tier to the other are available. The primary problem is the spring tension between rings which cause the rings to buckle when a rapid change of direction is imposed on a succession of them. (This is why, for example, redirecting rings from a reforming tub to a second conveyor in an abrupt and radically offset direction as described in U.S. Pat. No. 3,711,918 is impractical. If the rod were supple it might work, but many grades of steel rod are far too stiff and springy). However, changing direction radically and abruptly is feasible if the rings can be progressively confined and progressively held in place at the point of the turn against their spring force while the change of direction is being imposed until they are launched without tension between rings in the new direction. In the present invention, the curved chutes serve the purpose of progressively confining the rings against buckling while the change of direction is taking place. After the rings turn upside down and land on the conveyor below, they are pulled forward by the lower conveyor and proceed in the new direction without any tendency to buckle as long as their spacing is reasonably close to their original spacing.

In cases where it may be desirable to reduce the spacing between rings for slow cooling on the middle tier, the conveyor can be slowed down to provide a ring spacing of 0.3" and the rings will stack up at an angle. Guide rails may be employed to confine them laterally. In this condition the weight of the rings is sufficient to hold them in place and resist the tendency to buckle caused by compressing their spacing.

A height of at least two ring diameters is needed in order to assure smooth flipping action in the chutes; preferably 7'. In a revamp, this requires increasing the total height of the installation by 14'.

A second method of transferring the rings comprises the use of a large diameter drum at the end of the conveyor and a spring loaded mating belt arranged so that the rings enter the nip between the drum and the belt and are carried therein around the drum 180° at which point the nip between the drum and the belt opens up and the rod is deposited on the conveyor below. The spring loading of the belt is arranged to press the springs against the drum with enough pressure to hold them in place but not so heavily as permanently to deform them.

(d) The multi-tiered conveyor of the invention greatly facilitates versatility of treatment options Beside saving space and making it possible to improve the quality of medium-to-high carbon rod at very high production rates, the multi-tiered conveyor arrangement of the invention has a number of important advantages.

For example, in a revamp configuration, the entire critical forced air treatment of high carbon rod can be performed on the upper conveyor, with the rings cooling thereafter in ambient air on the 2nd and 3rd conveyors Ambient air cooling under these conditions (i.e. 3" spacing between rings) is adequate to cool the rod to handling temperature. Conversely, for the retarded cooling of low carbon rod, the forced air can be closed off from the first tier, and redirected to the third tier, so that the rod can be very slowly cooled for the first 410' (or 520') conveyor, and then cooled rapidly by forced air immediately prior to collection. This serves the same purpose as the water spray proposal described above. The advantage is, of course, that in the invention, it can be done without risk of chill hardening the rod, and the slow cooling cycle can be extended. In addition, it can be done without adding to the existing forced air fan capacity, as well as provide satisfactory slow cooling at very high production rates.

Another advantage is that hot air from the second tier can be ducted to the upper tier to enhance slow cooling.

A further important advantage of the invention is that a cheaper and more efficient conveyor for forced air cooling, of the chain-and-bar type can be used for at least part of the first and third conveyors, whereas a more expensive roller conveyor adapted for retarded (furnace assisted) cooling can be used for the middle conveyor. Thus, conveyors adapted for specialized treatments are not required to serve other purposes in a less efficient manner.

Of course, another advantage is that a customer can start with a revamp installation adapted solely for treating medium-to-high carbon rod in the manner of the invention, as well as low carbon rod in a retarded cool manner, without going to the expense of installing a furnace type slow cooling arrangement in a second tier—with the option of adding such a conveyor at a later date.

(e) The invention also includes a process referred to as "IRC" (Intermittent Reheat Cooling) for cooling low alloys and for annealing In processes which require extremely slow and uniform cooling as in the transformation of low alloys of steel, or for short term annealing (as in U.S. Pat. No. 3,939,015 see also 3,711,338), the major problems are the time required and the uniformity of the conditions. As for the time, even a 780′ conveyor may not provide enough time at high production rates, but this depends on the process. It should be adequate in many cases.

Uniformity is a different problem. The principal method in current use for attempting to achieve uniformity has been to slow down the conveyor so as to compact the rings more and to attempt to maintain the temperature of the surrounding atmosphere as uniform as possible. This would appear to be a logical approach by analogy to pot annealing, but the results on an extended conveyor have left room for improvement.

In the inventive process, a completely different approach to the problem has been taken by employing a method involving intermittent reheat cooling to which we refer by the acronyn "IRC". The concept of IRC is based on the fact that as the rod cools on a conveyor in an insulated chamber, the matted, overlapped parts cool very slowly (i.e. less than ½° C./sec) while the exposed rings cool much more rapidly (i.e. 2° C./sec). It follows, however, that upon heating, the converse also takes place. Thus, if the rings are reheated while still occupying the same relative positions, the exposed places regain temperature much more rapidly than the matted, overlapped places. Thus, by using small furnace sections and continuing insulated chambers between each small furnace, and regulating the temperature of the furnaces, the temperature decline of the matted places can be made to follow quite closely to any desired cooling curve while the temperature in the exposed places will fluctuate above and below the optimum but achieve an average temperature decline close to the desired curve.

In the high hardenability grades and low alloys, the effect of this more or less rapid alternating variation of the temperature above and below the desired cooling curve in the more exposed parts of the rod is to produce a very fine grained structure which shows superior properties in both toughness and ductility, even though those parts of the rod actually cool through transformation at rates which normally would produce martensite (see Grange, Trans. ASM Vol. 59, pp. 26–48). The result along the full length of the rod is to produce a rod which receives different treatment along its length, but in which the composite physical properties are substantially more uniform than has hitherto been possible by processes designed to duplicate pot annealing.

In connection with short term annealing, the fluctuations above and below the desired annealing temperature caused by IRC actually hastens the migration of the carbides and improves the product, provided the high side of the cycle is monitored accurately enough to avoid any substantial solution of the carbides.

An important advantage of using small, spaced IRC furnaces is that IRC cooling can be carried out at high production rates on a very long conveyor without requiring the virtually prohibitive cost of a furnace of the same length.

(f) Manipulation, shifting and replacement of the conveyor components of the invention The conveyors of the invention are made up of standard modular components which can be dropped in place, interchanged and replaced as desired, with ample access at the sides to remove cobbles as may be required. Each module is provided with means for tying it in to a common drive for all conveyor components.

The invention, accordingly, offers major increases in the speed of rolling with less cobbles and better rod quality for both high and low carbon steels, as well as a wide range of treatment options including retarded cool, and IRC for low alloys, and short term anneal, all within the framework of a revamp of an existing Stelmor mill within the same space, using the same fans, and the same rod bundle collecting, handling compacting, and inspecting equipment; all at a minimum of new capital expenditure.

DESCRIPTION OF THE DRAWINGS

Illustrative embodiments of the invention are shown in the accompanying drawings in which.

DETAILED DESCRIPTION OF THE INVENTION

Figure 2:
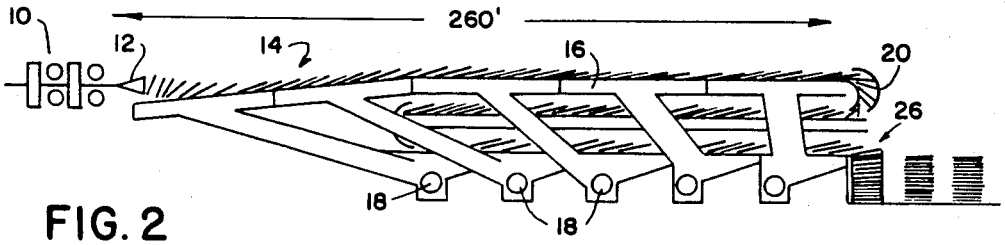
FIG. 2 is a diagrammatic view of an economic revamp of the installation of FIG. 1 employing the present invention.
Figure 3:
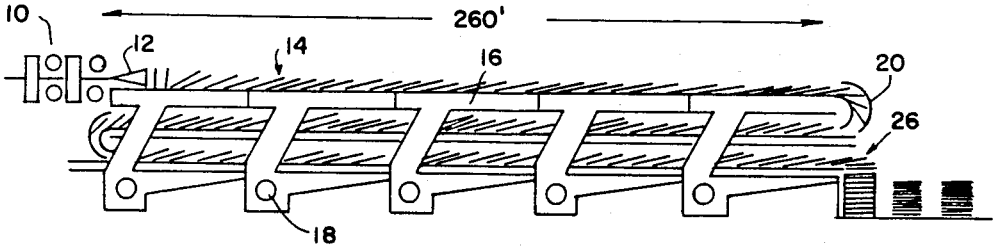
FIG. 3 is a diagrammatic view of a more expensive revamp of the installation of FIG. 1 than that of FIG. 2.

In the illustrative embodiments shown, the present invention employs a rod rolling mill, only the final four roll stands 10 of which are shown in the drawings. The rolling mill of the present invention is conventional except for the interstand cooling and that it is equipped to roll no. 5 rod at a delivery rate substantially in excess of 20,000 fpm (100 m/s). Immediately upon issuing from the final roll of finishing stand 10, the rod is directed through a guide tube into a rotating tube 11 of a horizontal (or inclined) axis laying head 12 (see FIG. 12) which immediately coils the rod into a succession of rings. The curve of the pipe in the laying head 12 is designed to project the rings forward with a preferred spacing between rings of 4". The reason for this spacing is that it is desirable for some cooling processes to which the rod will be subjected, to have a ring spacing of 3". The laying head 12 deposits the rings onto a multisectional conveyor indicated generally at 14 in FIGS. 2 and 3. In order to provide for uniform laying of the rings on the conveyor, a short conveyor section of wire mesh belting 15 (FIG. 12) is provided at the head of the conveyor at a point where the rings land on the conveyor. Side walls (not shown in FIG. 12) flanking the conveyor are employed to confine the rings laterally. In addition, the forward rate of travel of the conveyor is maintained so that it is at least 25% slower than the forward projection rate of the rings from the laying head 12. This is to ensure that when the rings touch down on the conveyor they will tip forwardly. For example, at rolling speeds in excess of 20,000 fpm, which the present invention makes more practical, the rings issue from the laying head at a rate of 33 rings/sec, and a forced rate of travel of 660' fpm. In this case, the conveyor speed will be operated at a maximum speed of 495 fpm. Although slower conveyor speeds are feasible, due to the fact that a landing point for the rings on the conveyor of a relatively uniform height is required, the conveyor should not be operated so slowly as to provide a ring spacing substantially below ½". If a slower speed for the conveyor is used, the rod tends to bunch up into irregular piles which are difficult to handle subsequently. This, at a rod delivery speed of 20,000 fpm and a 4' spacing between rings at a laying head, the preferred forward rate of motion of the conveyor is between 495 fpm and 80 fpm.

The multisectional conveyor 14 comprises three sections disposed vertically to form a tier. The sections will be referred to respectively as the top 17, middle 19, and bottom 21 conveyor sections.

After being deposited on the conveyor, the rings are immediately transferred from the wire mesh belts 15 to the top conveyor section 17, where, depending upon the type of treatment desired, the rod may be retardedly cooled, slowly cooled (by supplying heat to keep it from cooling too rapidly), or even heat treated (e.g. annealing) as desired. Normally, the top conveyor section 17 will be adapted only for rapid forced air cooling, and slow cooling. The forced air is supplied to air manifolds 16 under the conveyor, by fans 18 through ducts which convey the air in the manifolds. The fans 18 and ducts are arranged with appropriately adjustable baffling to apply the forced air alternatively to the top 17 or the bottom 21 conveyor sections or in part to both.

Preferably the top 17 and bottom 21 conveyor sections are constructed to provide an open framework of longitudinally extending, spaced bars 23 on which the spread-out rings slide being actuated in forward motion by means of chains 25 extending longitudinally of the conveyor on which spaced lugs 27 are arranged to contact the rings to assure continued forward motion of the rings. There are three wire mesh belts 15 in the initial short conveyor section arranged in parallel and spaced to accept chains 25 therebetween at the point of abutment between the initial short conveyor and top conveyor 17.

Figure 11:
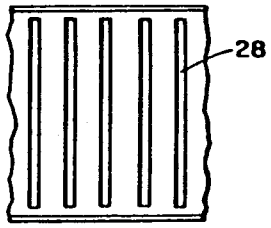
FIG. 11 is a fragmentary plan view of air slots in the floor of the conveyor of FIG. 10.
Figure 10:
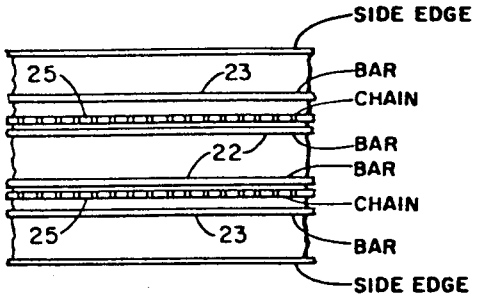
FIG. 10 is a fragmentary plan view of a bar-and-chain type conveyor.
Figure 9:
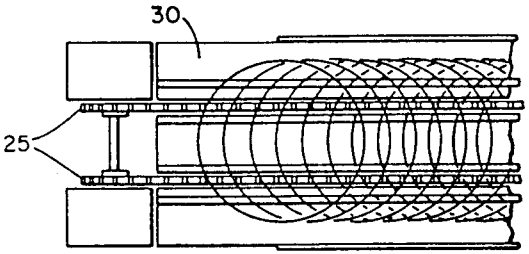
FIG. 9 is a fragmentary plan view of a conveyor adapted for slow cooling.

The air manifolds 16 are provided with spaced slots 28 (see FIG. 11) pointing upwardly (preferably at a forward angle) to direct air jets upwardly so as to impinge the air onto, through, and along the travelling rings. The application of the forced air is preferably (although not necessarily) of uniform intensity across the conveyor, and should have no substantial gaps longitudinally of the conveyor either at the edges or in the center of the conveyor.

The conveyor sections may be uncovered for rapid cooling or may have insulated covers 28 for retarded cooling. When retarded cooling is desired, baffles of insulating material 30 such as transite are placed between the bars 23 close to but below and not touching the rings. This reduces convective cooling to a minimum and achieves a cooling rate substantially below that obtainable by the insulated covers alone.

Figure 1:
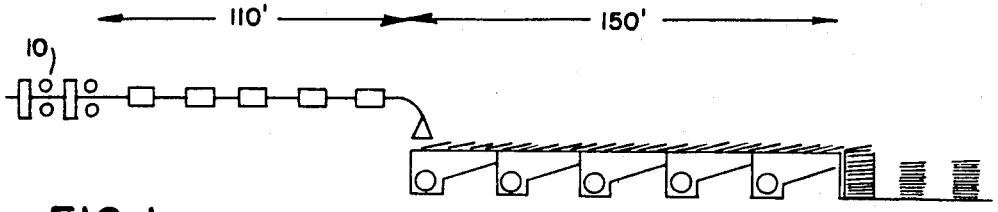
FIG. 1 is a diagrammatic view of a typical prior art rod cooling and collecting installation of the late 1960's of the Stelmor type.

In the context of a revamp of a typical existing Stelmor installation of the late 1960's in which a water cooling delivery pipe of 110' in length and a conveyor of 150' in length was employed (see FIG. 1), the top conveyor section 17 of the present invention can conveniently occupy the entire 260 feet of the prior lay-out. With such a length, and with the conveyor travelling at 495' fpm, the rod can be laid on the conveyor (at a spacing of 3" on centers), and cooled at an average rate of 14° C./sec. from a typical rolling temperature of 1020° to 980° C. down to 586° to 546° C. before it reaches the end of the top conveyor section. This means that, in the medium-to-high carbon content range the rod can be cooled through transformation entirely on the top section. This is important in the context of the present invention because it means that the critical cooling can be done without disturbing the rings and uniformity is achieved thereby, as will be further explained below.

Alternatively, the rod can be rapidly air cooled while in the first part only of the top conveyor 17 to a temperature approaching but still above transformation, and then held to a much slower transformation rate which is desirable for low alloy grades. These arrangements for the top conveyor section 17 are not mandatory. Thus, it can be equipped with heat resistant rollers 32 (see FIG. 4) instead of the bar and chain type of conveyor, and adapted for applying heat to the rod. On the other hand, it is considered preferable to arrange the conveyor sections so that the bar-and-chain form will be available where maximum forced air cooling will be required, i.e. on the top conveyor section 17 and the bottom conveyor section 21.

Figure 5:
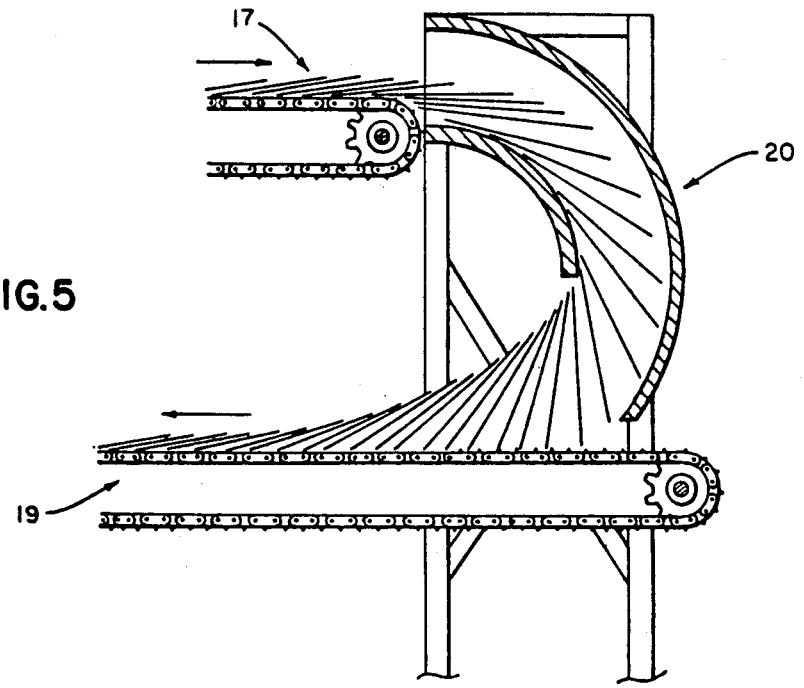
FIG. 5 is a view in side elevation of a curved chute for transferring rings from a conveyor above to a conveyor below travelling in the opposite direction.
Figure 6:
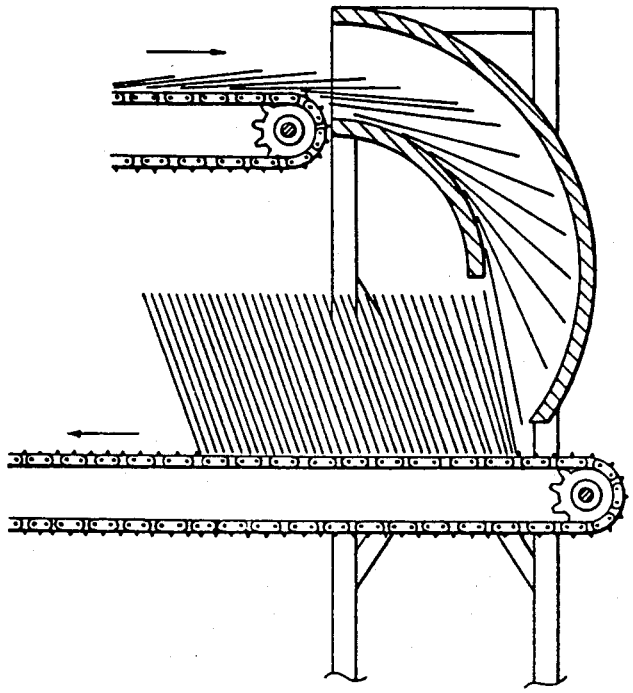
FIG. 6 is a view in side elevation of the same transfer mechanism of FIG. 5, but the conveyor below being operated very slowly so as to stack the rings in a form in which they can be more efficiently heat treated or transferred to inspection and storage.

At the end of the top conveyor section 17, the rod enters a curved chute 20 (see FIG. 5), into which the rings fall, and at the bottom of which they land on the middle conveyor section 19 travelling in the opposite direction. The middle conveyor section 19 then carries them back in the direction of the laying head 12.

The chute 20 is dimensioned laterally to accept the largest normally encountered ring sizes thus a reasonable margin for error up to 20%. The chute needs to be about 24% wide both to accept the rings as they flip over and to confine them against buckling in response to the spring force induced by the change of direction. Once they land on the middle conveyor section, provided it is travelling at the same speed, they snap back into the same relative alignment they had on the top conveyor section and have no further tendency to buckle. If closer spacing for prolonged retarded cooling is desired, the middle conveyor can be operated slow enough to produce a ring spacing of 0.3". The rings will then still slant in the same direction as in FIG. 5, but will remain at an angle, the weight of the rings keeping them in place. In the arrangement employing chute 20, gravity provides an important driving force for the flipping action which force is assisted at the end of the chute by the action of the conveyor below which is provided with a chain and lug arrangement adapted to make positive contact with the rings and bring them away from the lower exit end of the chute. Further along conveyor 19 the conveyor may be a roller conveyor, for retarded cooling.

Figure 7:
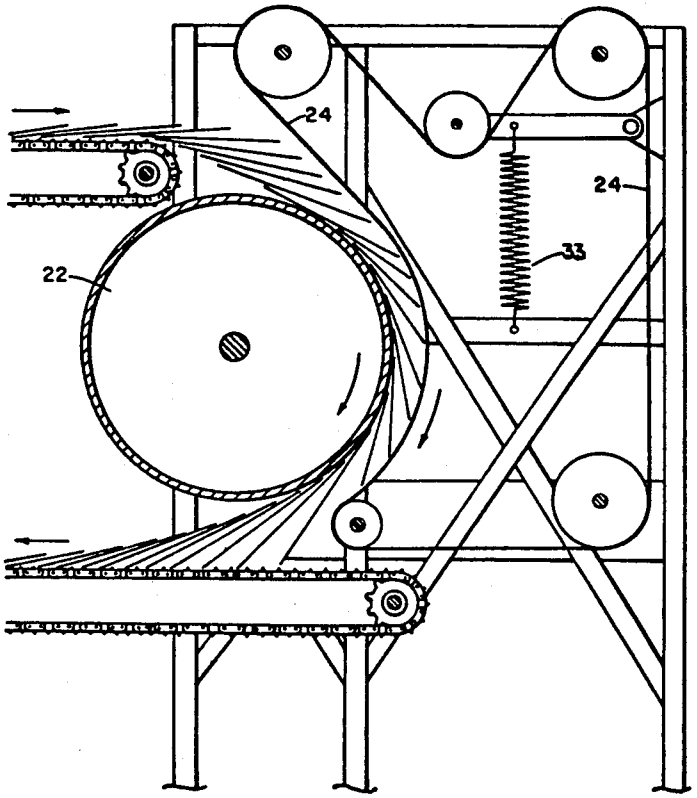
FIG. 7 is a view in side elevation depicting an alternative mechanism for transferring rings employing a pressure belt to hold the rings against a rotating drum.

An alternative means for transferring the rings from one conveyor to the next is shown in FIG. 7, in which a rotating drum 22 is mounted at the end of the top conveyor section together with a spring loaded restraining belt 24 arranged to provide a nip between the drum 22 and belt 24 to receive the rings issuing from the conveyor, carry them around through 180° of arc and then deposit them on the middle conveyor. A spring 32 is employed to tension belt 24, and is adjusted to provide sufficient tension in belt 24 to hold the rings against shifting while turning, but not so much tension as permanently to deform the rings during the transfer. By either of these methods, it is feasible to have a spacing of 7' to 9' between conveyor levels, which, in a three tiered installation entails an increase in height of the installation of 14' to 18'. In some cases this can be accommodated within the existing space. In others excavation or further elevation is required.

Normally the middle conveyor section 19, after the first few feet, will be of the roller type and will be equipped for supplying heat to the rod either to anneal it or to ensure slow cooling.

At the end of the middle conveyor section 19 the rod is transferred to the bottom conveyor section 21 by similar mechanism, and the bottom conveyor section 21 then conveys the rod to a reforming mechanism indicated generally at 26 of conventional construction.

The bottom conveyor section is normally of the bar-and-chain type and is equipped for forced air cooling.

By the foregoing arrangement, an economy revamp (see FIG. 2) of an existing Stelmor installation can provide 560 feet of conveyor while using the same conveyor for the bottom section as well as the same coil reforming, collection, inspecting, compacting, and transporting equipment as in the existing installation. Alternatively, as in FIG. 3, the existing Stelmor conveyor can be replaced by a longer conveyor at the bottom level and each of the three conveyor sections can be 260' in length giving a total of 780' of conveyor. Of course, even greater length can be provided in a totally new installation.

Among the processes which can be practiced with such an installation at very high delivery rates is a method for cooling medium-to-high carbon content rod in a manner whereby a rod of sufficiently high quality to serve as a replacement for lead patented rod can be rolled and cooled in sequence. This is done in the present invention by depositing the rod on the conveyor at a temperature at which the austenite grains are still rapidly growing (i.e. above 850° C.), and immediately starting to cool the rod through a first phase (Phase I) non-uniformly by passing air through and between the rings. As a result of the non-uniform cooling in the first phase, the austenite grains grow at substantially different rates. Thereafter the rod is cooled through a second phase (Phase II) in which transformation takes place and the cooling is maintained non-uniformly substantially in inverse ratio to the non-uniform grain sizes resulting from the non-uniformity of cooling in the first phase. In addition the average rate of cooling in the second phase parallels the optimum continuous transformation cooling rate for the steel in process. In this way the larger grains cool through transformation more slowly than the average, and the smaller grains cool through transformation more rapidly, substantially in conformity with the respective changes in cooling rate desired for the respective sizes of grain. The result is to produce a rod in which the free ferrite is extremely uniformly suppressed along its entire length, and in which the UTS can be over 8% higher than in conventionally processed Stelmor rod. This brings it into the area of a properly lead patented rod.

The rod product, however, is still quite different from a lead patented rod. For instance, the prior austenite grains in lead patented rod are substantially uniform along the length of the rod. This is true even in cases where a duplex grain structure is employed. In lead patenting, the same duplex structure prevails along the entire length of the rod. In the product of the present invention, the prior austenite grains vary substantially, in average size, from one place to another along the rod, but yet the suppression of free ferrite remains remarkably constant from end to end of a coil.

In plain carbon steels with relatively low manganese, i.e. on the order of 0.60% Mn, the greatest gains are observed when a laying temperature of over 1000° C. is employed. In a coarse grained steel, this results in grain sizes varying along the rod in the range of ASTM 5.5 to 8. Using ASTM grain size numbers is deceptive due to the geometric progression of the ASTM numbers. For example, ASTM 5.5 represents a grain count of 5553 grains/mm$^3$ whereas ASTM 8 represents a grain count of 65,000 grains/mm$^3$, i.e. a difference of nearly 1 to 12, a very significant difference. For this reason we will refer, for the remainder of this specification, to the grain count per cubic millimeter rather than to the aSTM grain size number.

Prior to our invention, it was generally thought that, once the temperature of the rod was depressed by water cooling to about 800° C. (1472° F.) as in Stelmor, thereafter practically no grain growth continued to take place. Our experiments show, however, that the grains are in fact still growing rapidly at that temperature. Thus with water-cooled Stelmor rod from a given normal heat of steel having a carbon content of 0.64% C, 0.59% Mn and laid at 780° C., when air was blown on it, the average grain count was 62,100 grains/mm$^3$ whereas when no air was blown on it, the average grain count was 39,790 grains/mm$^3$, showing that the grains were actually still rapidly merging to form larger grains even at that low temperature. This observation is contrary to the current general view of metallurgists on the subject.

That the grains are still growing rapidly at these low temperatures is important in our invention, because it accounts for the fact that the grain sizes vary so much along the length of the rod when it is being cooled non-uniformly from rolling temperature.

Thus, in a typical case with Stelmor rod made of a relatively coarse grained steel (nominally 0.63% C, 0.60% Mn) the grain size along the rod will vary on the order of ASTM 7 to 8.5 (23,000 gr/mm$^3$ to 124,475), that is a variation ratio of 1 to 5.4, whereas in one form of the practice of our invention the variation along the length of the rod in the same steel will be from ASTM 5.1 to 7.6 (3430 gr/mm$^3$ to 48,254 gr/mm$^3$), i.e. a variation ratio of 1 to 14. Thus, in the example given, there was 2.75 times as much variation in grain size in the inventive process than in Stelmor. In addition, the average grain count in the Stelmor sample was 4.4 times the average grain count in the inventive sample.

In another case, employing a fine grained steel (nominally 0.60% C. and 0.60 Mn), the Stelmor sample had an average grain count of 384,800 gr/mm$^3$ and a spread between 318,200 gr/mm$^3$ and 451,400 gr/mm$^3$, whereas the sample made by the inventive process had an average grain count of 65,000 gr/mm$^3$ and a spread between 43,700 gr/mm$^3$ and 111,800 gr/mm$^3$. Thus, although the numbers with the fine grained sample differed, the ratios were nearly the same. For example, the average grain count in the Stelmor sample was 5.9 times the average grain count in the inventive sample. Likewise, the spread in grain count in the inventive sample was nearly twice that of the Stelmor sample (1.4 to 2.6).

According to Grossmann & Bain (Principles of Heat Treatment, p. 71) isothermal transformation takes place at very different rates depending upon the size of the austenite grains. Thus, in one illustrative example they show that for a grain size of ASTM 4 to 5, (i.e. grain count of 1953 gr/mm$^3$) 50% transformation (at the nose of the curve) will be reached in 10 seconds, whereas it takes only 3 seconds at ASTM7-8 (grain count 44,160 gr/mm$^3$) and only 1.16 seconds at ASTM 8-9 (grain count 124,800 gr/mm$^3$). Quite clearly from Grossman and Bain's curves and also from experience in practice, if the large grains in the count range of 1020 to 2900 (ASTM 4-5) are cooled at a rate which would be suitable for grains in the count range of 23,000 to 65,000 (i.e. ASTM 7-8), martensite will be formed. Conversely, if the small grains are cooled at the slower rate required for large grains then excessive quantities of coarse pearlite and free ferrite will appear. These assumptions are easily demonstrated in a Stelmor installation by merely turning off the forced air. When this is done, massive free ferrite deposites occur and tensile strength falls off drastically throughout the coil even though some of the exposed parts of the rings cool in free air at a fairly rapid rate of up to 7° C./sec. This is how one would expect the more uniformly small grains of Stelmor to behave.

On the other hand, in the inventive process in the coarse grained sample, the grain count varied from 5568 for the largest grains (ASTM 5.5) to 48,254 for the smallest (ASTM 7.6) and by extrapolation from Grossman and Bain, the cooling rate through transformation must be at least twice as fast for the small grains as for the large ones. The tests showed that the same cooling rate relationship also applied to the inherently fine grained steel sample and that whatever it is in the inherently fine grained steel that inhibits grain growth also inhibits the transformation rate such that the austenite grains, although dimensionally small, do not have the same very fast transformation rate as the grains of that same size in the coarse grained steel.

In the inventive process, however, the cooling rates at various parts along the length of the rod vary substantially in inverse ratio to the respective grain sizes. This is done by maintaining the rod positioning in Phase II substantially the same as it was in Phase I while the rod was above transformation, that is, while the grains were growing. This is why we prefer to use a rod-and-chain type conveyor with the rod running straight and parallel to the direction of the conveyor. When the rings lie on such a conveyor, they assume a given position and keep it as they move along, shifting only slightly and the non-uniform cooling conditions stay the same. In a roller conveyor, however, the rings tend to shift more. Such shifting is useful in the Stelmor process in which the grains are more uniform and in which more uniform cooling is needed. In the inventive process, however, non-uniformity of cooling is needed. In fact, if the rings actually are shifted in any substantial way, then martensite or bainite will appear at the newly exposed places where the grains are large, and weakness and free ferrite will appear at the newly covered places where the grains are small.

In the inventive process, when it is controlled so that the rings do not shift and the cooling air is applied in substantially the same non-uniform manner during the grain size growing phase (Phase I) as during the transformation phase (Phase II), a remarkably uniform and thorough suppression of the free ferrite takes place together with an increase in tensile strength.

It should be noted also that the effective grain size vs. cooling rate compensation feature of our invention is time related in such a way that transformation must be reached while there still remains a potential change in effective grain size or grain boundary area in the steel at temperature approaching that of transformation. Thus, we have found that while using a plain carbon steel in the 0.64% C., 0.60% Mn range the average cooling rate from laying at rolling temperature to transformation should be sufficient to bring about an average start of transformation between 15 seconds to 35 seconds. When the time is less than 15 seconds, the grain size will not be large enough to develop significant improvement over standard Stelmor, whereas, when it is longer than about 35 seconds, a drastic decline in UTS is observed. It is believed that this is due both to a cessation in the potential for additional grain growth (grain boundary shortening) and an ensuring transformation at too slow a rate for the resulting grain size. These durations are, of course, related to the given grade mentioned, and will vary proportionally for other grades depending upon their characteristics.

Thus, with a coarse grained material as mentioned above (nominally 0.64% C. and 0.60% Mn, a typical practice of the Stelmor process will give a UTS of about 97 Kg/mm$^2$ (137,677 psi) and a free ferrite content (as measured extremely accurately with the Quantimet), Image Analyzing Computer made by Metals Research Ltd., Melbourne, Herts, England, of about 2.7%. By contrast with the same steel, the inventive procedure gives a UTS of 101 Kg/mm$^2$ (143,355 psi) for sub-optimum cooling in Phase I, up to 109 Kg/mm$^2$ (154,709 psi) and a free ferrite content of less than 1.5%. In addition, the free ferrite content in the product of the invention is substantially more uniform, has smaller particle sizes, and a wider distribution of particles than the Stelmor product.

The fine grained steel (nominally 0.60% C, 0.60% Mn) when processed according to Stelmor, will give a UTS of the order of 93 $Kg/mm^2$ (132,000 psi) with a free ferrite content of 3.35%. By contrast, the inventive procedure gives a UTS of 95 $Kg/mm^2$ (134,838 psi) for sub-optimum cooling in Phase I, up to 100 $Kg/mm^2$ (141,935 psi) for optimum conditions and a free ferrite content of less than 1.6%.

With a lower carbon content steel (nominally 0.55% C, 0.60% Mn a typical practice of the Stelmor process will give a UTS of 86. $Kg/mm^2$ (122,064 psi) and a free ferrite content of about 8% whereas the inventive procedure gives a UTS of as much as 92 $Kg/mm^2$ (130,580 psi) and a free ferrite content below 4.5%.

The inventive process, therefore, provides a unique product in that it has widely differing grain sizes along its length on the order of twice as much difference as that observed in a standard Stelmore product of the same steel, while at the same time a highly uniform free ferrite distribution and a quantity of free ferrite that is on the order of one half that observed in a standard Stelmore product of the same proeutectoid steel.

Coils processed according to the invention have been drawn successfully into finished wire without requiring patenting while still retaining ample ductility. The spread between UTS and 0.2% yield remains large in the rod of the invention, proportionally larger, in fact, than in Stelmor rod, thus, indicating superior work hardening properties, as one would expect from the reduction of free ferrite.

Tests run in conjunction with the development of the inventive process show that there is unexpectedly rapid and continuing grain growth even at temperatures below 800° C. Thus, whereas reheating the steel to 850° C. (1562° F.) requires three minutes to bring about a grain growth of ASTM 7.8 to 7.1, tests show a grain growth from ASTM 7.9 to ASTM 7.3 in only 10 seconds in the inventive process at a temperature as low as 780° C. (1436° F.) with the same steel.

These data are totally inconsistent. In fact, the grain growth rate at that temperature in the inventive process would not have been predicted from typical grain size and grain growth charts (see e.g. Making and Shaping, etc. 7th Ed.1957 (p. 796). In fact, this may be why the reaction taking place in the inventive process (i.e. non-uniform grain growth, non-uniform cooling compensation feature) was not hitherto noticed, or if noticed, thought to be in error.

The data seems to indicate that when the steel is freshly rolled and is cooling from a temperature well above $A_3$, the grain growth or grain boundary shortening conditions are more dynamic than in the reheat condition depicted in the tables shown in Making and Shaping. One major difference in the hot rolled case is that grain growth is not impeded by the endothermic reaction of the nucleation of new grains. In the reheat situation, the nucleation of a new grain site takes up heat. It seems likely that this would slow everything else around it down temporarily until new heat is conducted to the site. In the hot rolled situation, excess heat is already available everywhere and recrystallization and growth of grains does not reduce the temperature below that needed for the nucleation of new grains. Thus, grain growth can proceed much more freely after hot rolling, than in the reheat situation.

Figure 4:
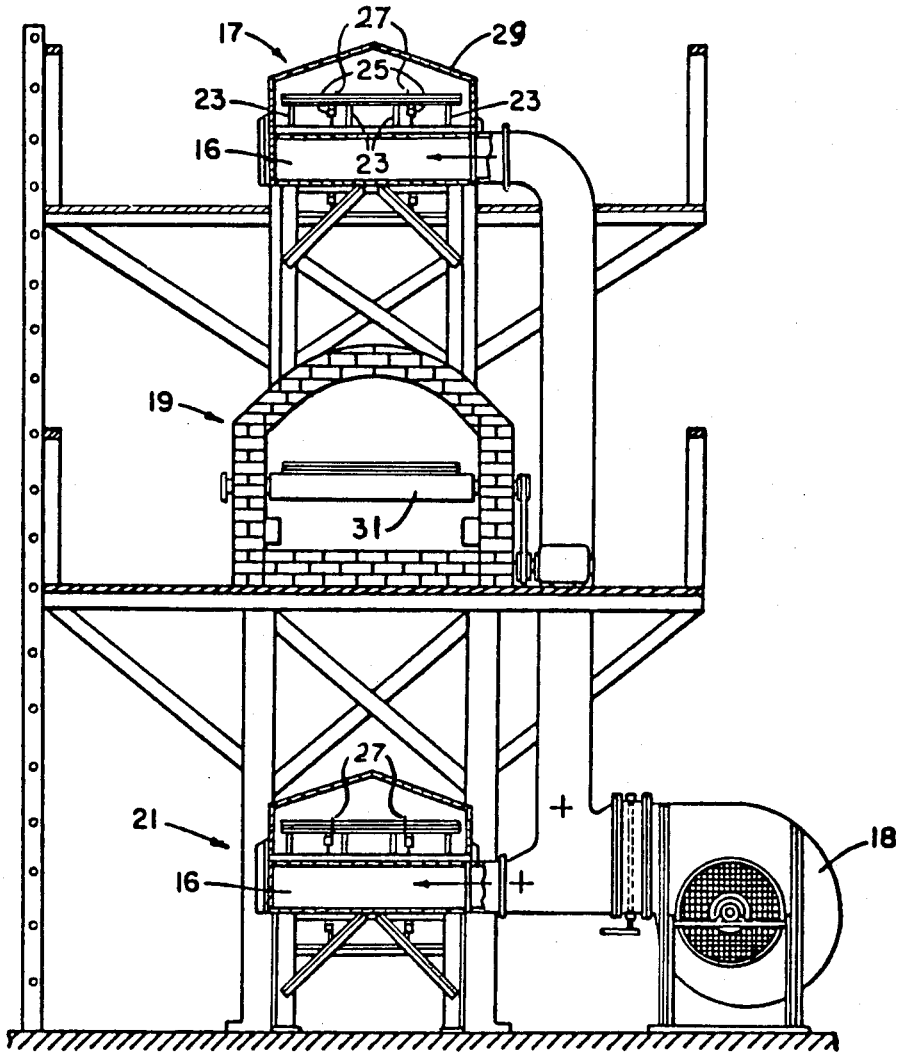
FIG. 4 is a a cross-sectional view in end elevation of a three tiered conveyor showing bar-and-chain type conveyors on the top and bottom tiers, and a roller conveyor within a furnace on the middle tier.

This explanation is also supported by evidence of mixed grain sizes (within a given cross-section) obtained in conventional air and lead patenting (see FIG. 4, Prediger-Parks Paper, Wire & Wire Products, 1968). In conventional patenting, unless the rod is allowed to soak for a long time at a given temperature, a mixed (duplex) grain results. (A uniform grain size is desirable in patenting, but the mill operators put up with the duplex form in the interest of increased production rate). The duplex grain condition suggests the nucleation-cooling thesis outlined above. Thus, the first grains to nucleate and recover their temperature can thereafter grow large, whereas the grains which nucleate later need time to recover their temperature and their growth is suppressed until they do. Thus they remain relatively smaller until long-term soaking permits equalization. In Stelmor, however, the grain growth proceeds uniformly everywhere in any given cross-section (see also FIG. 24 Prediger-Parks), and in the inventive process due to non-uniform cooling during the grain growth phase, widely differing grain sizes appear along the length of the rod.

In addition, in the condition in which a major percentage of the austenite grains are in the process of merging as in the case immediately following hot rolling, the grain boundary area of the grains will continue to contract while the grains adjust to a more nearly spherical shape. In this way a change in the grain boundary area, or effective grain size, can take place without an accompanying change in the actual grain count. Accordingly, when we speak, in this specification and in the claims of grain growth we intend to include both an actual grain count decrease and an effective grain boundary reduction due to contraction of grain boundary area. Both continue for a finite period of time even at temperatures approaching transformation, and they account for the compensation feature of the invention as described.

The scale formed in the inventive process is approximately 0.015 mm thick. This comes to about 1.1% of the cross-sectional area of 5.5 mm rod, but since the metal loss represented thereby is substantially less than the full thickness of the scale, the metal loss due to scale in those coils come to about 0.6%. This is about double the metal loss due to oxidation of a comparable Stelmor rod. As the rod diameter is increased, the scale loss decreases by the inverse square of the diameter all other things being equal. Thus, increasing the rod diameter will result in less scale loss.

Data shows that nearly the total quantity of the scale was formed almost entirely in the first 8 seconds after rolling, and since the rod is cooled relatively rapidly thereafter to below 250° C., as in Stelmor, very little degradation of FeO to $Fe_3O_4$ takes place. Thus, although more scale is produced by the inventive process than in Stelmor, it is composed largely of FeO which is easier to clean and in some cases is regarded as desirable as a protective coating. In addition, the tests indicate substantially lower decarburization at the metal surface in the inventive process than in Stelmor. This may be another indication of superiority of the inventive process over Stelmor.

The tests to date with the inventive process indicate the following rules appear to govern the uniformity of the rod and the optimization of its other properties. First, the more intense the air cooling is while the rod is on the conveyor, during the grain size growing phase (i.e. Phase I), the more difference there will be in the effective grain size. Second, the more intense the air cooling is during transformation (Phase II), the more difference there will be in the cooling rates through transformation in the various parts of the rod. In order to improve uniformity, of course, the difference in effective grain size produced by Phase I should be matched by the cooling rate differences in Phase II and in no case, of course, should the cooling rate in Phase II be so great as to cause bainite to form in any appreciable quantity. Once an appropriate match-up between effective grain size differences from Phase I and cooling rate differences in Phase II has been achieved safely below the bainite formation level, and a cooling rate has been selected so that transformation will be reached while there is still a potential for effective grain growth at temperatures approaching transformation temperature, then increasing the Mn content will prolong transformation and thereby result in increased tensile strength, all else remaining equal.

These considerations indicate that attempts to reduce the amount of scale by increasing the air blowing in Phase I, will need to be met by increasing the air cooling during Phase II. Apart from keeping the air cooling, however, in Phase II low enough to avoid bainite, there is a limit to the degree to which the air cooling can be effectively increased in Phase II. At a given air velocity, a maximum cooling level is achieved. Thereafter, the air velocity can be increased, but so doing achieves no additional cooling. Once this maximum point has been reached no further cooling rate difference compensation can be made and the question then becomes how much non-uniformity can be tolerated by increasing the cooling in Phase I. Also if the Phase I cooling is increased so as to reduce scale without a commensurate increase in Phase II cooling, the UTS will drop, because the austenite grains will be smaller (reducing the grain size without increasing the cooling results in loss of UTS). This loss, however, can be offset to some extent by increasing the manganese content. Increasing the carbon content can also be done, but it influences the grain size more and introduces a requirement for further adjustment. In addition, as mentioned above, the average cooling rate should be regulated so that the potential for effective grain growth still remains while the temperature of the rod is approaching transformation. In plain carbon steels this requires coiling at a temperature at least as high as 850° C. (preferably over 900° C.) and a cooling rate between about 8° C. and 18° C. (i.e. about 15 sec. to 35 sec. to reach transformation).

Optimum processing conditions can be achieved by first establishing the optimum air cooling on the conveyor for Phase II. This will vary according to the optimum continuous cooling curves for the particular steel in process, and must, of course, be much slower for high hardenability grades. Orifices extending across the conveyor should be used, and blowing should be applied generally to all parts of the rod. Once optimum Phase II cooling has been established, then the maximum tolerable Phase I cooling can be determined. Normally, the forced air in Phase I should start as soon as the rod is laid and be substantially less than in Phase II because at the higher temperatures of Phase I, radiant cooling is significantly greater. Thus, with a given application of air at a rod temperature of 850° C., a cooling rate of 14° C./sec can be attained with moderate air blowing, whereas at 700° C. the cooling rate with the same intensity of air blowing will drop to 10° C./sec. The preferred practice is to keep the cooling rate about the same in both phases. The reason for this is that it is impossible to match the cooling in Phase I and Phase II accurately if the cooling rates in either phase differ by very much. This is due to the inherent, local non-uniform cooling rates due to the overlapping condition of the rings which result in different parts along the rod reaching the end of Phase I and the start of Phase II at different times. If the cooling rate is changed at any point along the conveyor, then the match-up of rates for both phases is upset in proportion to the change.

The process can tolerate some mis-match between the cooling in the respective phases. For example, if the forced air cooling in Phase I is not applied at all for, say 5 to 7 seconds, and then excessive air cooling is used, a larger than optimum grain size spread results, as well as somewhat greater non-uniformity in tensile strength. On the other hand, a degree of non-uniformity can be tolerated, and, therefore, such a process although not considered optimal, still come within the spirit of the present invention.

In order to reduce scale, more air blowing can be applied in Phase I. This arrests both the grain and scale growths in the rapidly cooling, free parts of the rod while the grains and scale continue to grow at the overlaps. Thus, smaller grains appear and the grain size scatter is wider. In fact, even at the slow cooling places, the grains are somewhat smaller. However, if the Phase II cooling is not changed, the general reduction in grain size will result in a general reduction in UTS. This latter effect, however, is somewhat offset by a reduction in the scale in the rapidly cooled places. The parts of the rod where less scale forms also have higher cooling rates due to the improvement of heat transfer conditions at their surfaces. Thus, increasing the cooling in Phase I to reduce the scale loss, provides a minor automatic compensation for the grain size reduction. Whether this scale-related automatic compensation factor is adequate or whether adjustment of the optimums for Phase II to accommodate more rapid cooling in Phase I is needed, must also be determined experimentally in any particular case. The test data on hand indicates that blowing harder in Phase I increases non-uniformity of the UTS. Thus, the preferred practice is to blow more mildly in Phase I and gradually increase the air blowing as the temperature drops through the transformation range.

In connection with intermittent reheat cooling, i.e. "IRC", the rod is laid at 980° C. and is then immediately cooled for 34 seconds without any forced air, and with the rings travelling at 500 fpm on the top conveyor. In this condition, the cooling rate for the exposed parts of the rings starts at about 10° C./sec and for the edges it is about 5° C./sec and tapers off as the temperature drops. When the rings reach the end of the top conveyor, they drop through the chute to the next lower conveyor, and by then, the hottest places along the rod are at a temperature of about 810° C. and the coolest at about 640° C. The rod rings are then brought more closely together by moving the middle conveyor more slowly to give a spacing between rings of about 0.3" at a conveyor speed of 0.9 fps. Next, the conveyor passes through a first furnace of 10' in length and at a sufficiently elevated temperature to raise the temperature of the rod in its most exposed places at a rate of 10° C./sec. This brings the exposed places up to 780° while the temperature of overlapped places rises more slowly to only about 850° C. After leaving the furnace, the rod again cools down non-uniformly, but due to the closer spacing on the middle conveyor, the colder places tend to be warmed by surrounding rod, and new hot and cold places emerge due to the new position of the rings. Once the rings assume the new position on the middle conveyor, however, they retain it thereafter while they remain on that conveyor. Insulated covers and transite panels are used on the middle conveyor between the furnaces, to slow down the cooling. After the rings have cooled for a second time until the temperature of the coolest places has dropped again to 680° C., the rod is run through a second 10′ furnace in which the temperature is only high enough to induce a temperature rise of 8° C./sec. These steps are repeated, with less heat being added each time in the furnace until the rod reaches a temperature of between 710° and 680°, i.e. the transformation temperature. The exact temperatures, of course, will depend upon the grade of steel in process, and can be selected as determined by the test results. An arrangement employing 5 such furnaces and 40′ spacing between them on the middle conveyor will be sufficient in a typical case and an average cooling rate of about 0.2° C./sec through transformation can be achieved over a span of 4 minutes and 48 seconds. A more nearly uniform cooling cycle can be attained by employing smaller furnaces and shorter spaces in between.

The result is to cool the overlapped places more or less gradually through transformation, while the exposed places cool down to or slightly below transformation and then repeatedly rise to a higher temperature. The reaction at the exposed places is to produce a grain refinement as described in Grange Trans. ASM Vol. 59 (1966) at pages 27, 30, while in the overlapped places the desired patenting reaction is taking place. As a result, the rod has the desired microstructure in the overlapped places and a very fine grained, tough structure elsewhere which gradually varies from the desired structure to the tough structure. Such a product is clearly not the same as a properly patented rod, nor is it like the product Grange described, because those products have virtually the same structure along their entire length, whereas the rod of the present invention varies substantially along its length. On the other hand, the variations are not as damaging as one might expect. Due to the patented quality of the rod in the overlapped places and the toughness and ductility of the rod in the exposed places, the overall quality of the rod is sufficiently uniform to meet the industry standard of non-uniformity for a significant number of products.

In the context of short term annealing of low carbon rod as described in U.S. Pat. No. 3,939,015, the rod is cooled to a lower temperature on the top conveyor by forced air so that its average temperature is sufficiently below $A_1$ by the time it reaches the middle conveyor to start an annealing procedure. The rings are then taken through the small 10′ furnaces described above and the temperature of the furnaces is regulated to reheat the rod intermittently so that the temperature of the most exposed places rises close to but not above $A_1$ in such passage. In this case the repeated reheating enlarges the ferrite grains, and hastens the coalescence of the carbides. In addition a much more uniform product results than can be obtained by continuous annealing type treatment of rod rings on a conveyor passing through an extended furnace. Of course, the cost of five 10′ furnaces with 40′ insulated sections between is substantially less than would be the cost of a continuous furnace of the same overall length. In addition, the annealing process employing "IRC" can be controlled to bring the average temperature above $A_1$ and thereby hasten the coalescence of the carbides into spheroidal form.

The basic concept of IRC is temporarily and repetitively to reverse the direction of the heat flow paths associated with the overlapped rings such that the greater heat flow out of the more exposed places during the cooling phase is matched by greater heat flow in, in those same places during the reheat phase. This requires the use of a furnace as shown in FIG. 4 in which the rod is entirely surrounded by the heat of the furnace.

When the rod rings approach the end of the second conveyor, they are transferred onto a short conveyor section which is operated at a higher rate of, say, 5 fps which pulls the rings into a more open condition and accelerates them into a curved chute like the one previously described, which in turn deposits them onto the bottom conveyor travelling in the opposite direction. On the bottom conveyor the rings are cooled down to handling temperature and conveyed to a conventional reforming station shown only diagrammatically in FIGS. 1–3.

Figure 8:
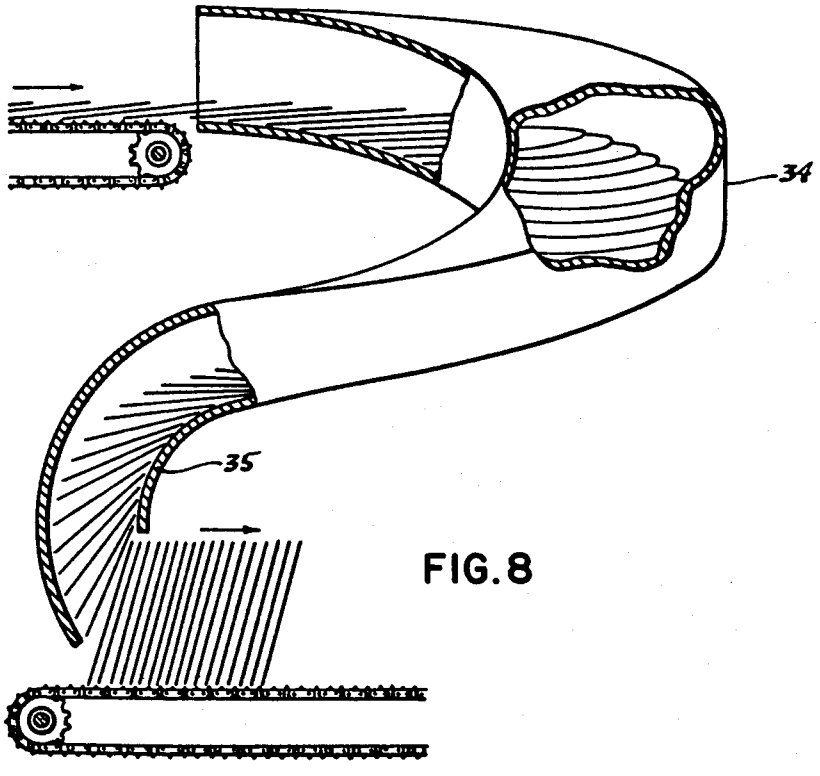
FIG. 8 is a view in side elevation of a curved chute and ring flipping mechanism for forming spread-out rings into bundles for inspection, compacting, storage and/or shipment.

Alternatively, the rings can be collected by projecting them into a spirally curved chute 32, see FIG. 8 and then flipping them downwardly in a chute 34 similar to chute 20, onto a conveyor between guide rails (not shown). In this arrangement, depending upon the angle at which the rings strike the lower conveyor (which can be varied as desired by the angle of the chute and the speed of the lower conveyor) the slope of the rings can be made to tilt forwardly, backwardly, or vertically. The vertical positioning is usual for conventional bundles and conventional compacting, but considerable saving in space can be made by laying it more horizontally than in conventional vertical coiling.

In addition, the direction of travel of the rings need not be changed by the use of the spirally curved chute, but can be made to double back as in FIG. 7. Alternatively, the conveyors can be arranged parallel to each other on the same or slightly different levels and the rings can be transferred around by retaining walls on a turn-table type conveyor (a'la airport baggage carrousel except flat). In this case the radius of curvature must be gradual enough to permit the weight of the rings to keep tham from buckling while turning. Experiments show that a mean radius of 18′ is satisfactory for No. 5 rod made of spring steel. Of course, arranging the conveyors on the same level requires more horizontal area and would be more difficult to do in the context of a revamp, but it has the advantage of more ready access to the conveyors, their covers, furnaces, etc.

In some cases, it may be desireable to collect the rod immediately at the end of the first tier. This can be done by moving the collecting tub 26 further away and replacing chute 20 with a straight chute which does not flip the rings but instead guides them into the collecting tub. This can also be done by a spiral chute as shown in FIG. 8 but without the end portion which flips the rings. As shown in FIG. 8 the chute turns only 180°, but it can, of course, be extended through 360' so as to return the ring travel direction to the same direction as the 1st and 3rd conveyor tiers, and to deposit the rings into the collecting tub at the end of the third tier. With such an arrangement, the second and third conveyor can be idle during production runs for which they were not required.

Figure 12:
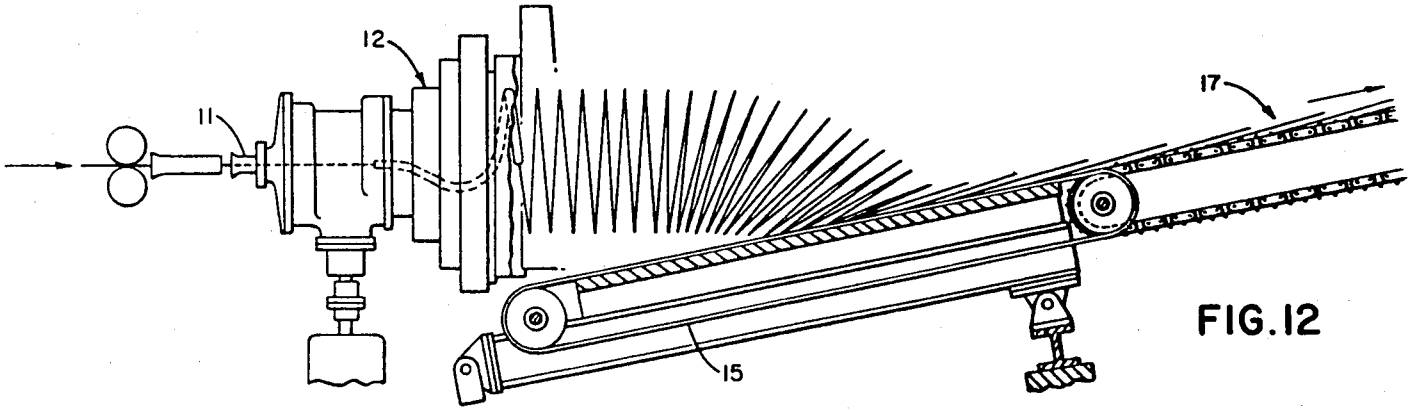
FIG. 12 is a view in side elevation of a horizontal axis laying head and conveyor adapted for very high rod delivery speed.

With respect to FIG. 12, it will be noted that the rod is being laid at a point about as near to the bar and chain conveyor as possible and that, at the conveyor speeds contemplated, the rings will rest on the belt 15 for only about one second. It also will be understood that the application of the air through orifices 28 starts immediately as the rod reaches the first section of the conveyor 17. In this way the period in which no forced air cooling takes place on the conveyor is reduced to a minimum. Precise controlling of the air flow through individual orifices 28 is done by providing them with adjustable louvers.

A wide variety of equivalent alternatives of the various aspects of the present invention will now be apparent to those skilled in the art and, therefore, it is not intended to confine the invention to the precise forms herein shown but rather to limit it solely in terms of the appended claims.

We claim:

1. A process for cooling rod rings laid in offset relation on a cooling conveyor consisting in the steps of:

(a) intermittently cooling the rings non-uniformly at spaced points along said conveyor, (b) intermittently reheating said rings non-uniformly substantially equally and oppositely to the non-uniformity of the cooling at spaced points along said conveyor between the points of cooling.

2. A process for controlling the temperature of metal rod spread out in overlapping rings on a treatment conveyor to conform substantially to a predetermined heat treatment time and temperature schedule comprising the steps of:

(a) cooling the rod from a starting temperature which conforms to said schedule so that the temperature in the overlapped places of said rings is slightly below said scheduled temperature, and the temperature in the exposed places is substantially below said scheduled temperature;

(b) applying heat to said rings to bring the temperature of the exposed places up substantially above said scheduled temperature, and the temperature in the overlapped places only slightly above said scheduled temperature; and (c) continuing steps (a) and (b) alternately until the completion of the time of said schedule.

3. The process of claim 2 further characterized by: said time and temperature schedule conforming to a continuously descending cooling curve.

4. The process of claim 2 further characterized by: said time and temperature schedule conforming to a constant temperature heat treatment.

5. The process of claim 2 further characterized by: the metal being fresh from hot rolling and the starting temperature of step (a) being the temperature of rolling.

* * * * *

UNITED STATES PATENT AND TRADEMARK OFFICE

CERTIFICATE OF CORRECTION

PATENT NO. : 4,491,488

DATED : January 1, 1985

INVENTOR(S) : Robert B. Russell

It is certified that error appears in the above-identified patent and that said Letters Patent is hereby corrected as shown below:

On the title page, the inventor should read:

--(75) Inventors: Robert B. Russell, Chestnut Hill, Mass.--

Signed and Sealed this

*Eighth* Day of *October 1985*

[SEAL]

*Attest:*

DONALD J. QUIGG

*Attesting Officer*

*Commissioner of Patents and Trademarks—Designate*